US005865955A

United States Patent [19]

Ilvespääet al.

[11] Patent Number: 5,865,955

[45] Date of Patent: Feb. 2, 1999

[54] METHOD AND DEVICE FOR ENHANCING THE RUN OF A PAPER WEB IN A PAPER MACHINE

[75] Inventors: Heikki Ilvespää; Juha Kaihovirta; Antti Kuhasalo, all of Jyväskylä; Jorma Laapotti, Palokka, all of Finland

[73] Assignee: Valmet Corporation, Helsinki, Finland

[21] Appl. No.: 726,195

[22] Filed: Oct. 4, 1996

[30] Foreign Application Priority Data

Apr. 10, 1995 [FI] Finland ..... 954714

[51] Int. Cl.[6] ..... D21F 11/00; D21F 5/18

[52] U.S. Cl. ..... 162/207; 34/123; 34/629; 34/643; 34/464; 162/206; 162/290; 162/359.1

[58] Field of Search ..... 162/205, 206, 162/207, 359.1, 290, 375; 34/123, 629, 643, 116, 464

[56] References Cited

U.S. PATENT DOCUMENTS

| | | | |
|---|---|---|---|
| 3,303,576 | 2/1967 | Sisson | 162/109 |
| 3,868,780 | 3/1975 | Soininen et al. | 34/116 |
| 3,874,997 | 4/1975 | Kankaanpaa | 162/290 |
| 3,956,832 | 5/1976 | Justus | 34/115 |
| 4,361,466 | 11/1982 | Wong et al. | 162/207 |
| 4,648,942 | 3/1987 | Wanke et al. | 162/286 |
| 4,815,220 | 3/1989 | Wedel | 34/120 |
| 4,931,143 | 5/1990 | Karvinen et al. | 162/359.1 |
| 5,022,163 | 6/1991 | Ilvespääet al. | 34/23 |
| 5,087,325 | 2/1992 | Page | 162/359.1 |
| 5,178,732 | 1/1993 | Steiner et al. | 162/360.3 |
| 5,256,257 | 10/1993 | Schiel | 162/360.3 |
| 5,319,863 | 6/1994 | Kotitschke et al. | 34/414 |
| 5,389,205 | 2/1995 | Pajula et al. | 162/205 |
| 5,588,223 | 12/1996 | Marshall | 34/414 |
| 5,607,551 | 3/1997 | Farrington, Jr. | 162/109 |

FOREIGN PATENT DOCUMENTS

| | | |
|---|---|---|
| 72162 | 1/1984 | Finland . |
| 72549 | 4/1985 | Finland . |
| 84741 | 1/1988 | Finland . |
| 9323616 | 11/1993 | Finland . |

OTHER PUBLICATIONS

"Trends In High Speed Machines For Newsprint And Groundwood Papers", Donald A. Ely, Pulp & Paper, Apr., 1983, pp. 100–103.

*Primary Examiner*—Karen M. Hastings
*Attorney, Agent, or Firm*—Steinberg & Raskin, P.C.

[57] ABSTRACT

A method and device for enhancing the run of a web in a paper machine in which water is removed from the web by pressing the web in at least one press nip and after pressing, the web is dried in at least one dryer group applying impingement drying. The web is guided along a substantially linear path or by using a large curve radius in the dryer group applying impingement drying. In the drying stage, after the impingement drying, the web is dried in at least one dryer group having normal single-wire draw. The web is passed from the pressing stage to the drying stage as a closed draw and more particularly, from the pressing stage to the area with single-wire draw in the drying stage so that the web is constantly supported against at least one support face.

37 Claims, 12 Drawing Sheets

METHOD AND DEVICE FOR ENHANCING THE RUN OF A PAPER WEB IN A PAPER MACHINE

FIELD OF THE INVENTION

The present invention relates to a method in a paper machine or equivalent for improving or enhancing the run of a paper web or equivalent in a paper machine including a dewatering portion in which the web is dewatered by pressing. In a pressing stage, the paper web or equivalent is pressed in at least one press nip and after pressing, the paper web or equivalent is dried in at least one dryer group based on impingement drying or equivalent. The paper web is guided through the at least one dryer group applying an impingement drying technique along a substantially linear path or by using a large curve radius and in the drying stage, after the impingement drying, the paper web or equivalent is dried in at least one dryer group in which a normal single-wire draw is applied. Further, the paper web is passed from the pressing stage to the drying stage as a closed draw.

The present invention also relates to a device in a paper machine or equivalent for enhancing a run of the paper web which comprises at least one press nip and at least two dryer groups. The paper web or equivalent has a closed draw from the last press nip to the first dryer group and a substantially linear draw or a draw with a large curve radius through the first dryer group.

BACKGROUND OF THE INVENTION

Increased running speeds of paper machines provide new problems to be solved, which problems are mostly related to the runnability of the machine. Currently web running speeds of up to about 1600 meters per minute are employed in printing-paper machines. At these speeds, the so-called closed press sections, which comprise a compact combination of press rolls arranged around a smooth-faced center roll generally operate satisfactorily.

With increasing running speeds of paper machines, the problems of runnability of a paper machine are also manifested with higher emphasis, because a web with a high water content and low strength does not endure an excessively high and sudden compression pressure impulse or the dynamic forces produced by high speeds, but web breaks and other disturbances in operation arise and cause standstills. In a modern printing-paper machine, the cost of standstill time is today about FIM 60,000 per hour ($13, 200).

Further problems manifested with increased emphasis at high speeds of paper machines, for which problems, at least for all of them in toto, satisfactory solutions have not been found as yet, include the problems of quality related to the requirements of uniformity of the profiles of properties of the paper web both in the machine direction and in the cross direction. Uniformity of the web produced by the paper machine also affects the runnability of the entire paper machine, and it is also an important quality factor of finished paper, which is emphasized in the case of copying and printing papers with increasing speeds of copiers and printing machines and with higher requirements imposed on the uniformity of the printing result.

Recently, even speeds as high as about 40 meters per second (2400 meters per minute) have been contemplated as running speeds of paper machines. Application of running speeds as high as these, in particular in wide machines, provides ever more difficult problems to be solved of which problems, the most important ones are runnability and adequate dewatering capacity of the machine at a high speed.

With respect to the prior art related to the press section of a paper machine, reference is made to U.S. Pat. No. 5,389,205 (Pajula et al.), which is hereby incorporated by reference herein, which describes a method and device for dewatering a paper web by pressing. In this patent, a method is suggested in the manufacture of paper or board for dewatering the paper web that is being manufactured and that has been drained in the web former of the paper machine. In the disclosed method, the dewatering takes place by passing the paper web on support of fabrics that receive water through a number of successive dewatering nips so that, by the effect of the compression pressure, water is transferred out of the fiber mesh of the paper web into the spaces in the fabric that receive water and into the spaces in the hollow faces of the mobile dewatering members, such as press rolls. Further, the paper web is transferred from the forming wire onto the wire of the dryer section while constantly on support of a fabric that receives water, a transfer fabric, or any other, corresponding transfer surface as a closed draw at a speed that is higher than about 25 to about 30 meters per second. It has been considered as one of the novel aspects of this prior art method that, in the method, dewatering of the paper web is carried out by means of at least two such successive press nips of which nips at least one press nip is a so-called extended-nip zone whose length in the machine direction is larger than about 100 mm, and the extended-nip zone is formed in connection with a mobile flexible press-band loop. The distribution of the compression pressure employed within the extended-nip press zone is regulated and/or selected both in the cross direction of the web and in the machine direction so as to set or to control the different profiles of properties of the web. Also, as the first press stage, a dewatering pressing is carried out on the web forming wire by using a press zone and a water-receiving, relatively open fabric or fabrics running through that press zone.

As known from the prior art, in multi-cylinder dryers of paper machines, twin-wire draw and/or single-wire draw is/are employed. In twin-wire draw, the groups of drying cylinders comprise two wires which press the web, one from above and the other one from below, against the heated cylinder faces of drying cylinders situated in two separated rows. Between the rows of drying cylinders, which are usually horizontal rows, the web may have free and unsupported draws which are susceptible to fluttering, which may cause web breaks, in particular as the web is still relatively moist and, therefore, has a low strength. Therefore, in recent years, ever increasing use has been made of the single-wire draw in which each group of drying cylinders comprises only one drying wire on whose support the web runs through the entire group so that the drying wire presses the web against the heated cylinder faces of the drying cylinders and the web remains at the side of the outside curve of the reversing cylinders or rolls situated between the drying cylinders. Thus, in single-wire draw, the drying cylinders are arranged outside the wire loop, and the reversing cylinders or rolls are arranged inside the loop.

With increasing running speeds of paper machines, problems of runnability have also started occurring in the area of single-wire draw, in particular in the first groups in a dryer section. In a manner known from the prior art, attempts have been made to reduce these problems by using various components of runnability, such as the Uno Run Blow Box (the current assignee's trade mark) and by replacing the lower roll by a suction roll, for example a VAC-roll. However, so far, the running speeds are not yet known up to a level at which these prior art constructions are sufficient to support the web in the beginning of the dryer section when the speeds continue to become higher.

With increasing speeds of paper machines, the runnability of a paper machine is, of course, also affected by the dryer section, whose length with the prior art multi-cylinder dryers would, at high speeds, also become intolerably long. If it is imagined that a present-day multi-cylinder dryer were used at a web speed of about 40 meters per second, it would include about 70 drying cylinders, and its length in the machine direction would be about 180 meters. In such a case, the dryer would comprise about 15 separate wire groups and a corresponding number of draws over the group gaps. It is to be assumed that, in a speed range of from about 30 to about 40 meters per second, the runnability of the prior art multi-cylinder dryers would no longer be even nearly satisfactory, but web breaks would be frequent, which would lead to a deterioration in the efficiency of the paper machine.

In a speed range of from about 30 to about 40 meters per second and at higher speeds, the prior art multi-cylinder dryers would also become uneconomical because the cost of investment of an excessively long paper machine hall would be unduly high. It can be estimated that, at present, the cost of a paper machine hall is typically about one million FIM per meter in the machine direction (about $220,000).

It is known from the prior art to use various impingement drying/through drying units for evaporation drying of a paper web, which units have been used in particular for drying tissue paper. With respect to the prior art related to this, reference is made, e.g., to U.S. Pat. Nos. 3,874,997, 3,868,780, and 5,319,863.

With respect to the prior art related to the present invention, reference is made to an article entitled "Trends in high speed machines for newsprint and groundwood papers", Pulp & Paper, April 1983, pages 100–103. In this paper, among other things, a newsprint machine is described which is operated at a speed of about 1000 meters per minute and in which, in the dryer section, a web support of full width is employed without draws between the dryers. In a pre-dryer in the dryer section, vacuum boxes and vacuum rolls are arranged inside the wire in order to keep the web in contact with the belt. The web is dried in the pre-dryer in the dryer section by means of hot air to a dry solids content of from about 45% to about 50%.

With further respect to the prior art, reference is made to U.S. Pat. No. 4,361,466 which describes a method and mechanism for removing water from a web in a paper machine in which there are press members and a first dryer unit based on heating in which there is a long, continuous, endless support belt which carries the web during the first drying cycle. In the first drying cycle, the rolls and the suction zones are placed below the web and there are members that blow hot air, as well as members by whose means the air blow is directed at the web, on the first heat-treatment run on which the web is received substantially at a dry solids content of about 40% and from which the web is removed substantially at a dry solids content of about 50%. In this prior art construction, the paper web arrives and departs as an open draw into/from the pre-drying unit.

In addition, with respect to the prior art, reference is also made to the U.S. Pat. No. 5,256,257 which describes a construction in which a non-water-receivable transfer belt runs through two press nips and transfers the web to the dryer section as a supported draw so that the web can be heated/dried by impingement drying between the press and a group with single-wire draw.

In a manner known from the prior art, the web is passed from the press section to the dryer section so that the web has been separated from the last smooth roll in the press section and passed by means of a guide roll to the dryer section, in which case the web has had a free draw directly after the press section. This passage has proved problematic, in particular because of the increased risk of web break in this connection. In order to amend this, a closed draw has been developed from the press section to the dryer section, such a closed draw being described, for example, in U.S. Pat. No. 5,389,205 mentioned above, in which the web is passed from the press section by means of a transfer belt to a group with single-wire draw in the dryer section. As is well known to those skilled in the art, a web tightness arising in connection with an open draw improves the running quality of the web, and in closed draws of the web, attempts have been made to produce a web tightness by using a difference in speed between the different support fabrics. This has, however, produced problems because in such a case, the support fabrics are subjected to rapid wear. In paper machines having very high web running speeds an adequate web tightness has not been achieved by means of a difference in speed, in which case the web has not followed the wire in the dryer section but rather, owing to its slackness, it has caused web breaks, fluttering, and similar problems.

The wet strength and the elastic properties of a paper web depend on the dry solids content of the web, and directly after the press section, it has been problematic to make the web sufficiently tight because the web has not been sufficiently dry thereat. For this reason, in cylinder groups with single-wire draw, which are often placed in the beginning of the dryer section, i.e., in so-called slalom-draw groups, problems have been encountered in the runnability, in particular in high-speed paper machines. As one solution, short groups of just a few cylinders have been employed in the beginning of the dryer section, so that by means of a positive difference in speed between the groups, it has been possible to maintain web tightness. This solution, however, increases the costs of investment end operation because of the increased number of wire circulations.

Moreover, when tightening of the paper by means of differences in speed between support fabrics has been employed, the paper web may be constricted unevenly, and high differences in tension applied to the web may cause problems in achievement of a sufficiently uniform quality, in particular in relation to the cross-direction profile of the paper.

OBJECTS AND SUMMARY OF THE INVENTION

Accordingly, it is an object of the present invention to provide novel solutions for the problems mentioned above so that these problems in the prior art and problems that will come out later are substantially avoided.

It is another object of the present invention to provide a new and improved method and device for enhancing the run of a web, in particular between a press nip or pressing stage in a press section of a paper machine to a dryer group having single-wire draw in a drying section of the paper machine.

In view of achieving the objects stated above and others, in the method in accordance with the invention the paper web is passed from the pressing stage to an area with single-wire draw in the drying stage so that the paper web is constantly supported against at least one support face.

The device in accordance with the invention includes an arrangement whereby the last press nip in the press section and the first dryer group in the dryer section are placed and constructed in the paper machine so that the paper web or equivalent is constantly supported by at least one support face on its run from the press section to the first group that applies a normal single-wire draw in the dryer section.

By means of the present invention and particularly the different embodiments thereof shown in the accompanying drawings, it has been possible, in a novel and inventive way, to combine certain component solutions or constructions, some of them in themselves known from the prior art paper machine technology, so that the problem of different natures discussed above is brought under control and solved by means of a novel overall concept.

The most important object achieved by means of the invention is satisfactory runnability of the paper machine even at speeds as high as about 30 to about 40 meters per second. This is achieved partly as a result of the "linear" closed draw of the web, whereby the runnability remains on a good and adequate level.

In the present invention, the prior art impingement drying and/or through drying and the contact drying by means of heated contact-drying cylinders are combined in a novel manner. In order that the objectives of the invention can be achieved with the high web speeds concerned, i.e., velocity greater than about 25 meters per second, in particular in the speed range of from about 30 to about 40 meters per second, the drying stages and the drying geometry are arranged in a novel manner.

Moreover, in the present invention, the factor, decisive in view of the runnability of the dryer section, has been taken into account such that a stable run and uniform tightness of the drying wire and thus undisturbed running of the web on support of the drying wire are ensured by providing the wire with a curved run in the impingement drying and/or through drying areas. Alternatively, the run consists of relatively short straight draws placed at a small angle in relation to one another yet so that the curve radius is sufficiently large and the centrifugal force that attempts to separate the web from the wire remains minimal and detaching of the web is prevented in all cases.

A large curve radius in the impingement drying and/or through drying areas is particularly favorable also when the web is dried between two wires. A curved face always produces a detrimental difference in speed between the wires, the magnitude of this difference becoming higher when the curve radius becomes shorter. With a large curve radius or with a substantially straight draw, it is possible to obtain such a small difference in speed that the paper web is not damaged between the wires or that the wires do not abrade each other to a substantial extent.

In the arrangement in accordance with the present invention related to a paper machine, there is no free draw from the press section to the dryer section, but a fully closed draw is employed by means of at least one support felt/support wire. In the beginning of the dryer section, drying by means of impingement drying or equivalent drying devices is employed, in which case the problems of slalom draw do not occur because the running direction of the web is substantially linear or has a large curve radius. Preferably, the draw from a dryer group based on impingement drying into a group with normal single-wire draw is also closed.

In a preferred exemplifying embodiment of the invention, in the initial part of the dryer section, impingement drying units are arranged at both sides of the web. In these impingement drying units, air or steam or an equivalent drying medium is used to enable drying of the web. The web runs through a gap arranged between the impingement drying units on support of two support fabrics, and the support fabrics are open. The permeability of the drying wires can be, for example, about 10,000 to about 20,000 cu.m/sq.m/h (cubic meters per square meter per hour) at a difference in pressure of about 100 Pa. By contrast, in conventional single-wire draw, the permeability of the drying wire is, as a rule, only about 2,000 cu.m/sq.m/h (at a difference in pressure of about 100 Pa). In another preferred exemplifying embodiment, the support fabrics used in dryer groups based on impingement drying tolerate a temperature higher than about 190° C., i.e., higher than the temperature tolerated by the drying wires used in groups that make use of normal single-wire draw.

Since, the web is passed as a substantially linear run and preferably supported from two sides in the initial part of the dryer section in the arrangement in accordance with the invention, the runnability of the web is not problematic. Moreover, since the wire runs under support from the press unit into the dryer unit, the paper web having a low strength is not separated from the support at any stage until it has been dewatered and dried to a sufficiently high dry solids content, at which stage its strength is higher. In the first group in the dryer section, based on impingement drying or equivalent, the dry solids content of the paper web can be raised sufficiently, in which case it is easier to treat the web in the subsequent groups provided with single-wire or twin-wire draw. When a dry solids content of the web is about 45% to about 55% after the press section, after the impingement drying unit or equivalent used in the arrangement in accordance with the present invention the dry solids content of the web is about 50% to about 70%.

In some arrangements in accordance with the invention, when a transfer belt and a transfer wire are used, the difference in speed between these support belts ro wires can be adjusted to the desired level. In other preferred exemplifying embodiments of the invention, a difference in speed is not needed to adjust the tightness of the paper, in which case the paper is also constricted uniformly. Also, in this manner the desired cross-direction profiles of the web are reached, whereby paper having a substantially uniform quality is obtained.

By means of impingement drying devices used in the dryer section, an abundance of drying capacity is obtained when dry air or superheated steam is blown substantially perpendicularly against the paper at a relatively high velocity. In such a unit, a high evaporation rate is obtained, which is about 3 to 4 times as high as in an average dryer unit based on cylinder drying. By means of impingement drying, the paper web is dried until its dry solids content is preferably high enough so that it can endure the strains of single-wire draw. At high web running speeds, the dry solids content typically varies in the range of about 55% to about 65%, depending among other things on the basis weight and raw material of the paper web. Impingement drying can also be used so that drying that makes use of normal single-wire draw is introduced when the web starts shrinking to a substantial extent, i.e., when the dry solids content of the web is less than about 60% to about 65%. In such a case, the natural drying shrinkage of the web compensates for the web-stretching effect of the strains applied to the web by the single-wire draw, and a web tightness that ensures good runnability does not have to be maintained by means of differences in speed between the groups.

BRIEF DESCRIPTION OF THE DRAWINGS

In the following, the invention will be described in detail with reference to the accompanying drawings which are illustrative of some embodiments of the invention and are not meant to limit the scope of the invention as encompassed by the claims, wherein.

DETAILED DESCRIPTION OF THE PREFERRED EMBODIMENTS

Figure 1:
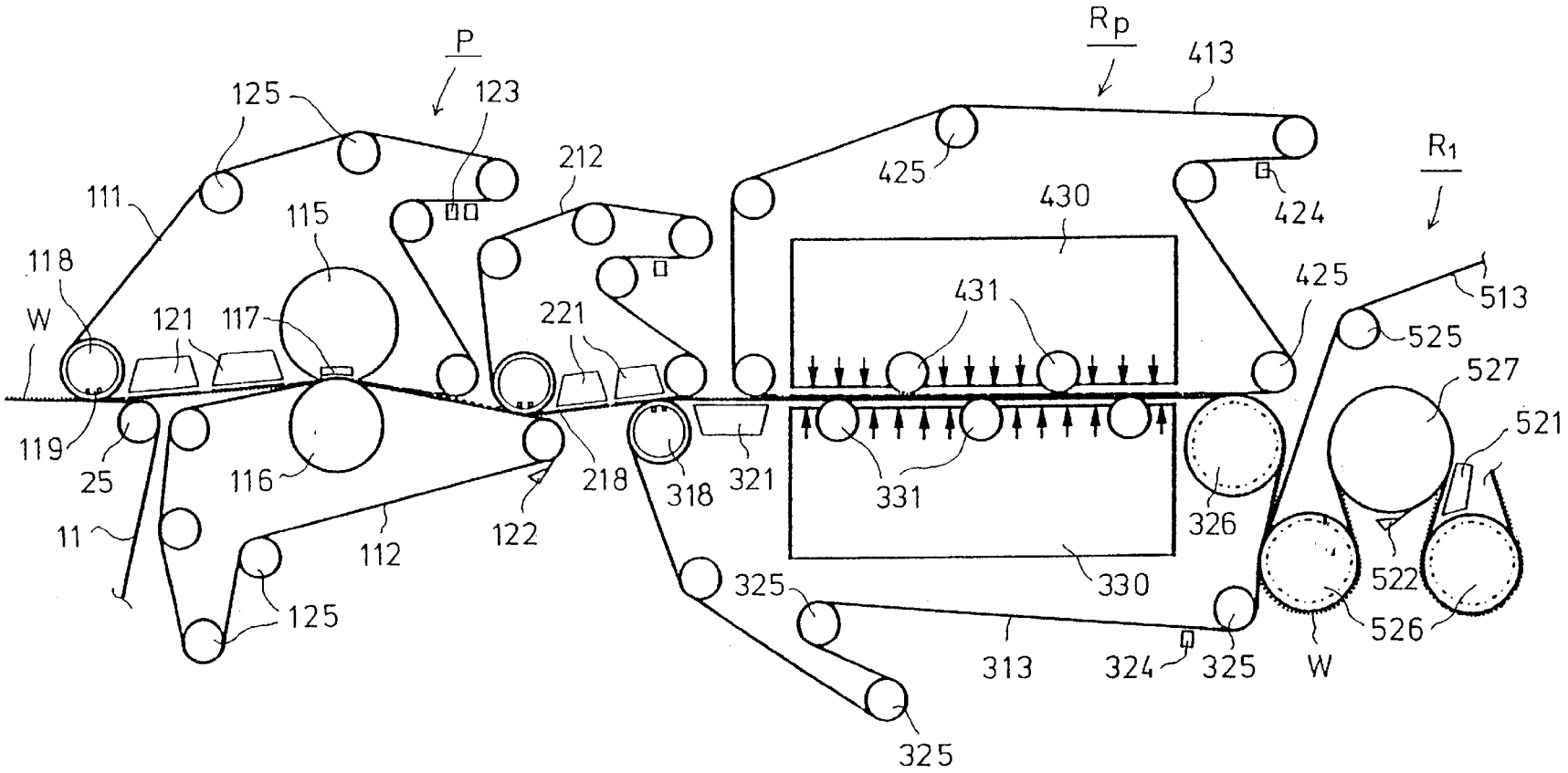
FIG. 1 is a schematic illustration of an exemplifying embodiment of the invention in which the web is passed from the press section to the dryer section on support of a separate transfer fabric.

Referring to the accompanying drawings wherein the same reference numerals refer to the same or similar elements, in each exemplifying embodiment, equivalent parts in different sections are denoted with corresponding tens and unit numbers increased by hundreds.

In the exemplifying embodiment shown in FIG. 1, a paper web W is passed into a last press nip P in the press section on support of a press felt 11 of the preceding press nip in the press section. From the press felt 11, the paper web W is transferred by means of a transfer suction roll 118 having a suction zone denoted by reference numeral 119 onto the support of an upper press felt 111 on which the dewatering of the web W is aided by means of blow suction boxes 121. The paper web W is carried on the press felt 111 and passed thereon into the press nip formed by an extended-nip press roll 115 and a backup roll 116 in which water is removed out of the web W by virtue of the pressing action of an extended-nip shoe 117 arranged in association with the extended-nip press roll 115. The upper press felt 111 runs in a path guided by guide rolls 125, and the press felt 111 is conditioned by means of felt conditioning devices 123, which comprise a wash jet and felt suction devices. Below the felt 111, a transfer belt or transfer fabric 112 runs and is guided by another set of guide rolls 125 to run between the extended-nip press roll 115 and the backup roll 116. From the extended-nip press formed by components 115,116,117, the paper web W is passed as a closed draw into a first group Rp in the dryer section. Supported by the lower transfer fabric 112 of the press nip P, the paper web W is passed over the suction roll 218 onto a transfer fabric 212 on which the web W is kept by means of blow-suction boxes 221, and further the web is subsequently transferred from this transfer fabric 212 onto a lower drying wire 313 in the dryer group Rp by means of a transfer suction roll 318. The support of the web on the lower drying wire 313 is aided by means of a blowsuction box 321, or other equivalent web adhesion and support means.

The dryer group Rp comprises two impingement drying units 330,430 as well as related support rolls 331,431, over which a respective drying wire 313,413, viz., an upper wire 413 and a lower wire 313, run while guided by separate sets of guide rolls 425,325, respectively. The conditioning devices for the drying wires 313,413 are denoted by reference numerals 324,424, and in a conventional manner, the conditioning devices comprise washing and drying means. From the lower drying wire 313, the paper web W is passed into the next group R1 in the dryer section, which group is, in the exemplifying embodiment shown in FIG. 1, a normal group provided with single-wire draw and thus comprises VAC-rolls or suction rolls 526 arranged in a lower row and drying cylinders 527 arranged in an upper row above the row of suction rolls 526. The guide rolls in the dryer group R1 are denoted by reference numeral 525, and the drying wire running over the guide rolls 525 is denoted by reference numeral 513. A doctor 522 cleans the drying cylinder 527, and a blow-suction box or an equivalent device that stabilizes the run of the web in the dryer section is denoted by reference numeral 521.

Thus, as shown in FIG. 1, the paper web W is passed from the last press nip P in the press section as a fully closed draw, viz., by means of the upper transfer fabric 112 and the transfer fabric 212, onto the lower drying wire 313 in the dryer group Rp, after which the paper web W is passed through the gap between the impingement drying units 330,430, which are provided with two drying wires 313,413 that are highly permeable, further to the next, normal group R1 with single-wire draw.

In this exemplifying embodiment, the transfer fabrics 112,212 can be used to regulate the difference in speed to the desired level (which aspect is discussed above). The paper web W runs along a substantially linear path as a horizontal draw from the press section to the dryer section through the first group Rp in the dryer section, whereby the web reaches a dry solids content of about 50% to about 70% after which the transfer of the web in a conventional single-wire draw is easier from the point of view of runnability, or the avoidance of problems with the runnability of the web.

Figure 2:
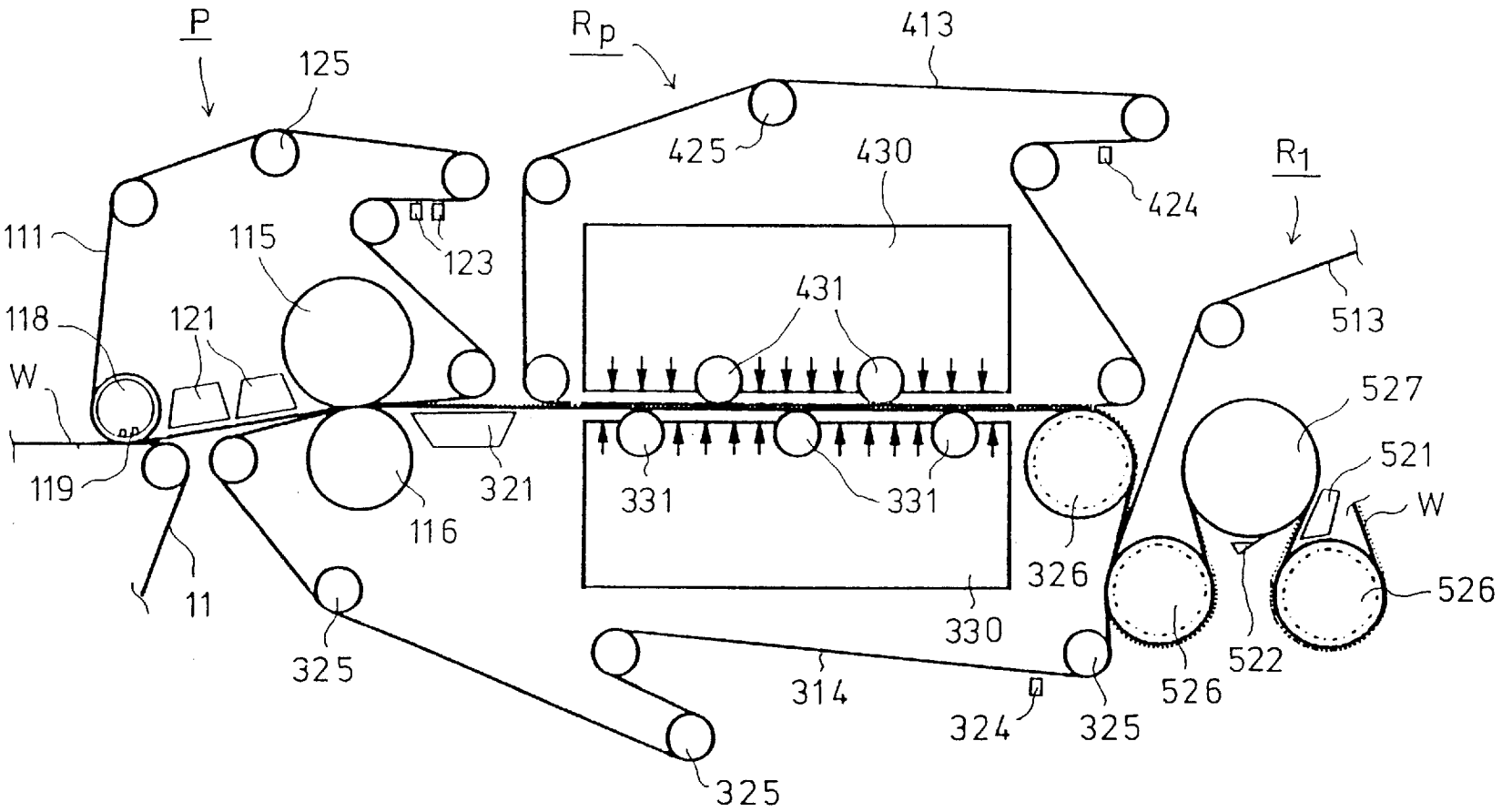
FIG. 2 is a schematic illustration of a preferred exemplifying embodiment of the invention in which The lower support fabric in the dryer unit extends up to the press section.

In the embodiment of the invention shown in FIG. 2, the paper web W is passed from the preceding press group on support of the press felt 11 onto the upper press felt 111 of the press nip P by means of the transfer suction roll 118, and is passed on support of the press felt 111 with the aid of the blow-suction boxes 121,321 into a roll-nip press which is formed by the press roll 115 and its backup roll 116. The lower drying fabric of the first dryer group Rp in the dryer section also operates as a press fabric, i.e., the web W runs on support of the press/drying fabric 314 into the impingement drying group Rp in the dryer section, in which group the paper web W is dried by means of the impingement drying units 330,430. In the area of the impingement drying units 330,430, the run of the web is also guided by support rolls 331,431. The paper web W runs through the dryer group Rp on support of the drying wire 413 and the press/drying fabric 314 (sandwiched therebetween) over a VAC-roll or suction roll 326 to the next group in the dryer section, which group is a dryer group R1 with normal single-wire draw, in which the rolls in the lower row are VAC-rolls or suction rolls 526 and the drying cylinder is denoted by reference numeral 527.

The paper web W runs as a substantially linear horizontal run from the last press nip P in the press section into the first dryer group Rp in the dryer section, which group applies impingement drying. In this exemplifying embodiment, it is highly advantageous that the paper web W having a low strength is not separated from anything until it has been dried in the first group Rp in the dryer section to a sufficiently high dry solids content, i.e., the paper web W runs constantly as a closed draw.

Figure 3:
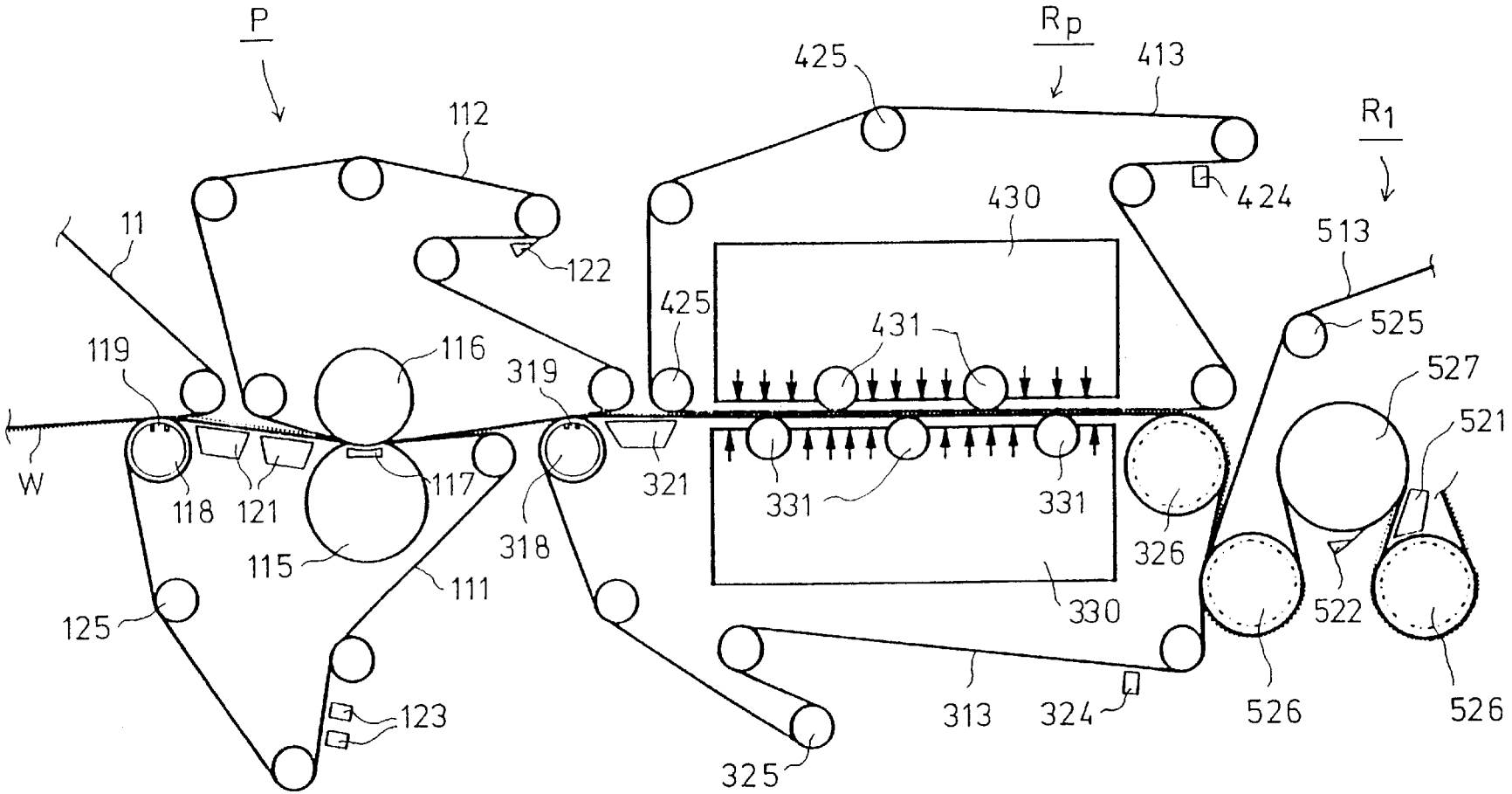
FIG. 3 is a schematic Illustration of an exemplifying embodiment of the invention in which the transfer belt also operates as the last upper support fabric in the press section.

FIG. 3 shows an exemplifying embodiment similar to FIG. 1, wherein the last press nip P is, however, placed upside down, i.e., so that the extended-nip press roll 115 is placed below the paper web W to be dried and the upper roll is the backup roll 116 over which a transfer fabric 112 runs. Transfer fabric 112 is guided in a run to extend over the lower wire 313 of the dryer group Rp in order to facilitate a closed draw web transfer thereto. The paper web W thus runs as a closed draw from the press to the dryer section.

The dryer group Rp comprises impingement drying units 330,430 between whose respective drying wires 313,413 the paper web W to be dried runs as a substantially linear horizontal run to the next group R1 in the dryer section, which is a group that applies normal single-wire draw. Thus, in dryer group R1, the paper web W runs in a meandering path over the outer face on the VAC-rolls or suction rolls 526 in the lower row and between the drying wire 513 and the face of the drying cylinder 527 in the upper row.

Figure 4:
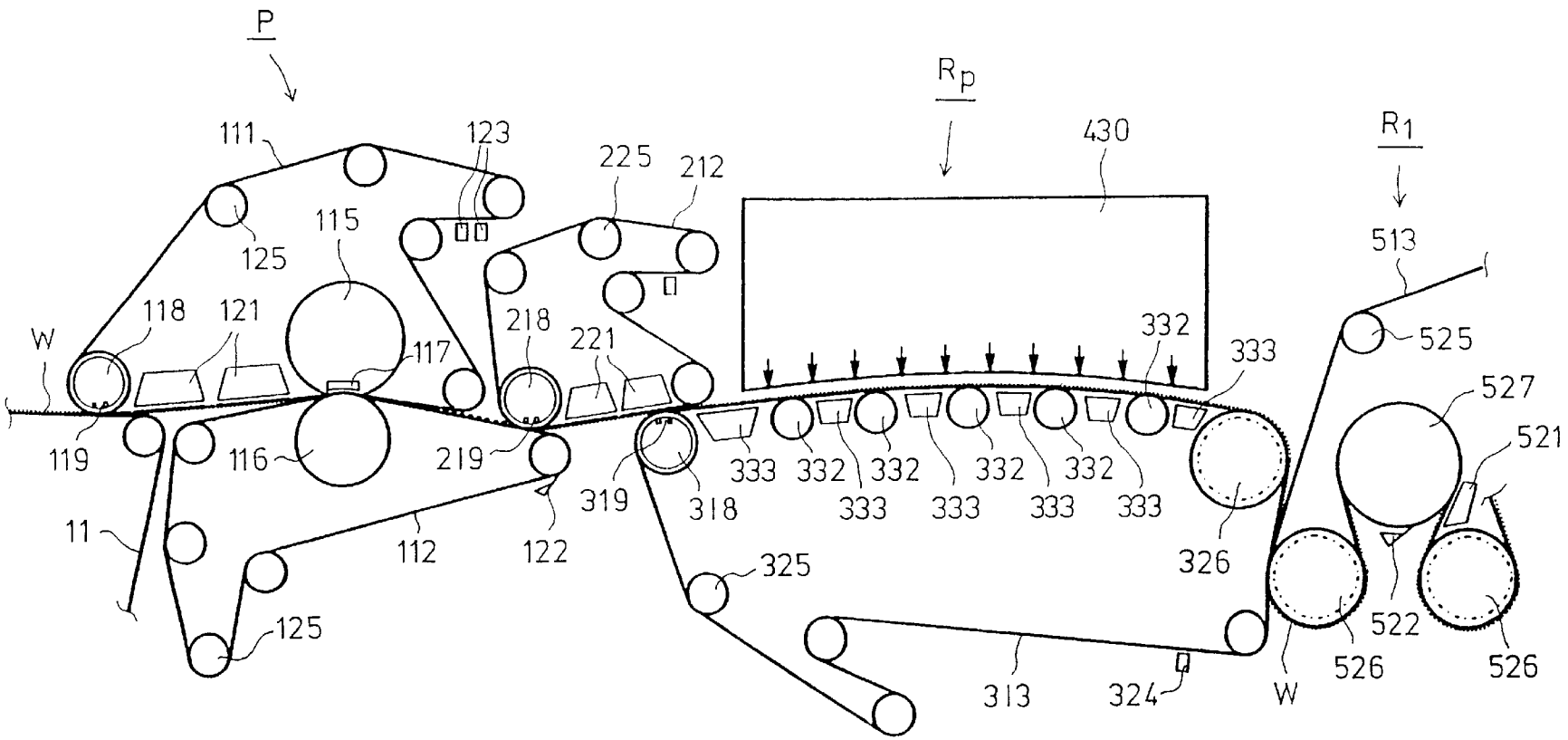
FIG. 4 is a schematic illustration of an exemplifying embodiment of the invention in which an upper impingement drying unit and lower blow-suction boxes are employed in the dryer section.

In the exemplifying embodiment shown in FIG. 4, the press nip P is similar to the exemplifying embodiment illustrated in FIG. 1, and from the press nip P, the paper web W is passed on support of the transfer fabric 212 onto the lower drying wire 313 in the next dryer group Rp. Blow-suction boxes 333 and support rolls 332 are placed inside the loop of the lower drying wire 313. Above the paper web W, an impingement drying unit 430 is placed. The paper web W runs from the last press nip P in the press section as a closed draw, while being guided by the lower transfer fabric 112, the upper transfer fabric 212 and the drying wire 313 along a substantially linear path, through the entire first dryer group Rp towards the group with single-wire draw, i.e., the slalom group R1.

Figure 5:
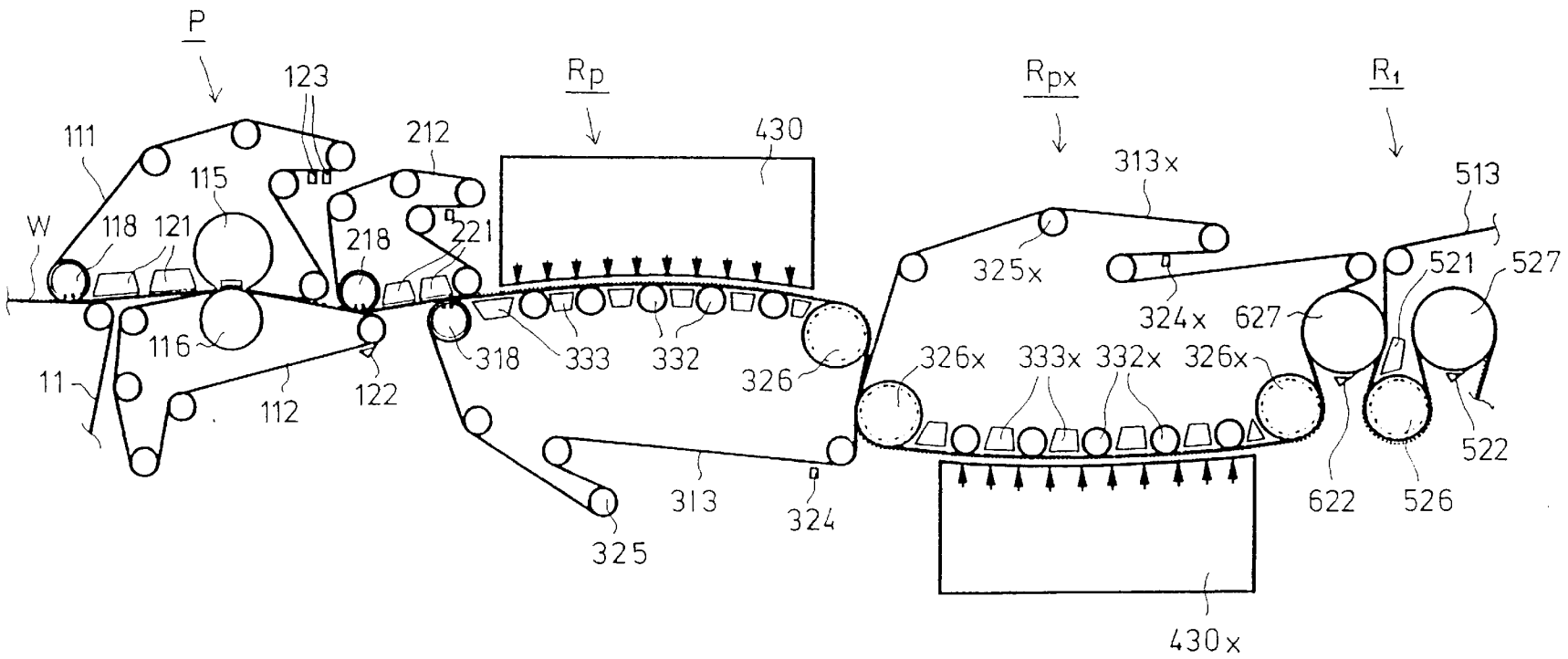
FIG. 5 is a schematic illustration of an exemplifying embodiment of the invention in which the first unit in the dryer section is provided with an upper impingement drying unit and the next unit with a lower impingement drying unit.

In the exemplifying embodiment of the invention shown in FIG. 5, the first impingement drying group Rp in the dryer section is followed by an inverted impingement drying group Rpx in which the drying wire 313*x*, the blow-suction boxes 333*x* situated in the loop of the drying wire 313*x* and the support rolls 332*x* also situated in the loop of the drying wire 313*x* are placed above the web, and an impingement drying unit 430*x* is placed below the paper web W to be dried. After this inverted impingement drying group, a group R1 with normal single-wire draw is arranged and the web W is passed from the inverted impingement drying group RPx over a drying cylinder 627 into the drying group R1 with normal single-wire draw.

Figure 6:
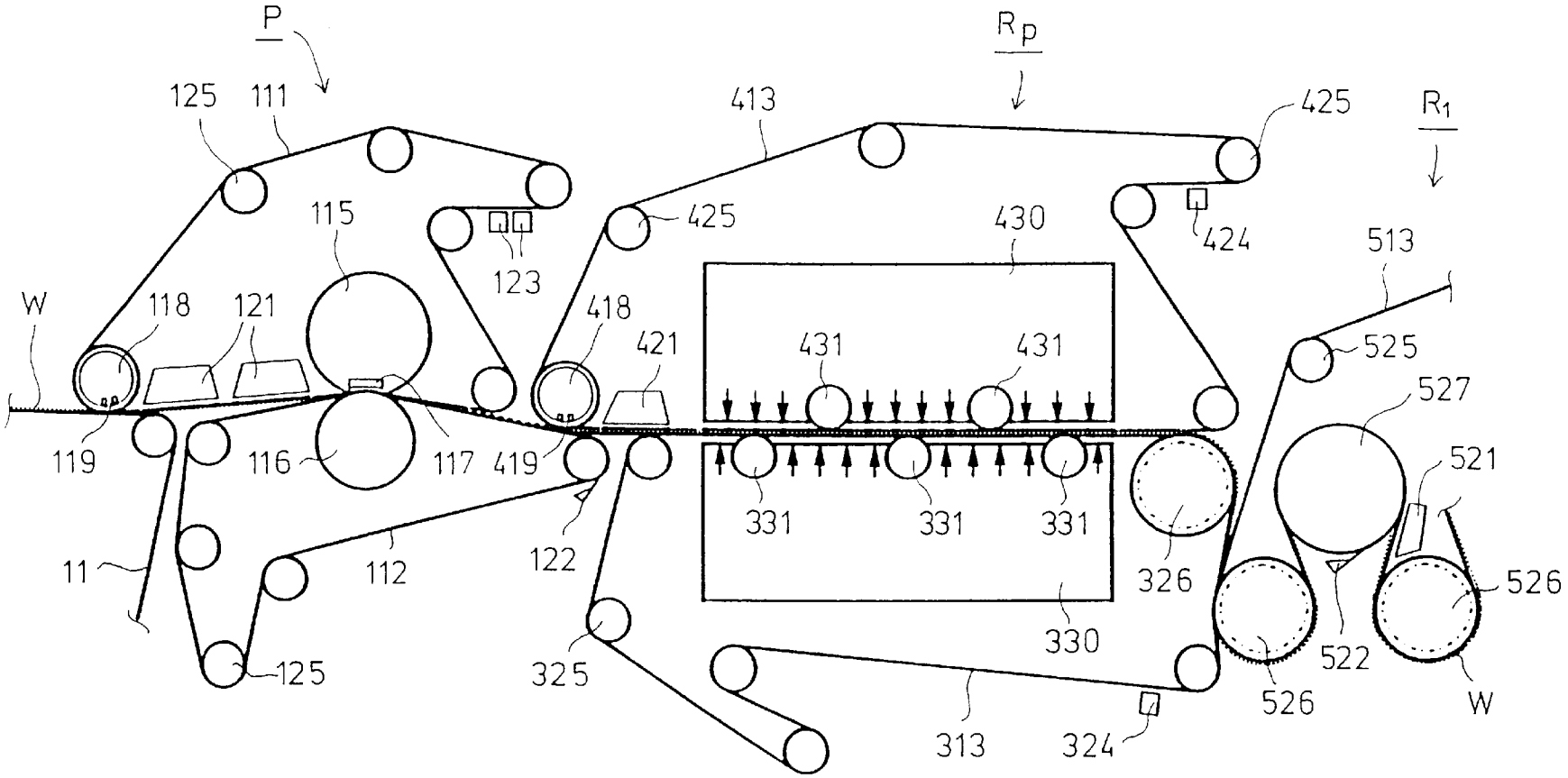
FIG. 6 is a schematic illustration of an exemplifying embodiment of the invention in which the paper web is passed from the last press nip in the press section by means of a lower transfer belt so as to be supported on the upper drying wire in the first unit in the dryer section.

In the exemplifying embodiment of the invention shown in FIG. 6, in the last press nip P in the press section, the extended-nip press consists of an extended-nip press roll 115, whose press shoe is denoted by reference numeral 117, and a backup roll 116 in opposed relationship to the extended-nip press roll 115. The upper press felt 111 runs in a guided path by the guide rolls 125 and the paper web W is taken or transferred from the preceding press group by means of the transfer suction roll 118 onto the support of the press felt 111, which support is aided by the blow-suction boxes 121 arranged in the loop of the press felt 111. The transfer belt or transfer fabric that runs around the backup roll 116 is denoted by reference numeral 112, and the paper web W is transferred on the upper face of the transfer belt into the first group Rp in the dryer section to be supported on the upper wire 413, onto which the paper web W is transferred by means of the transfer suction roll 418, and the support is aided by the blow-suction box 421. After this transfer to the upper wire 413, the paper web W runs between the impingement drying units 330,430, supported by the upper wire 413 as well as a lower wire 313, and aided by the support rolls 431,331. From the VAC roll or suction roll 326 placed inside the loop of the lower wire 313, the paper web W is transferred to the next dryer group R1, which applies single-wire draw.

Figure 7:
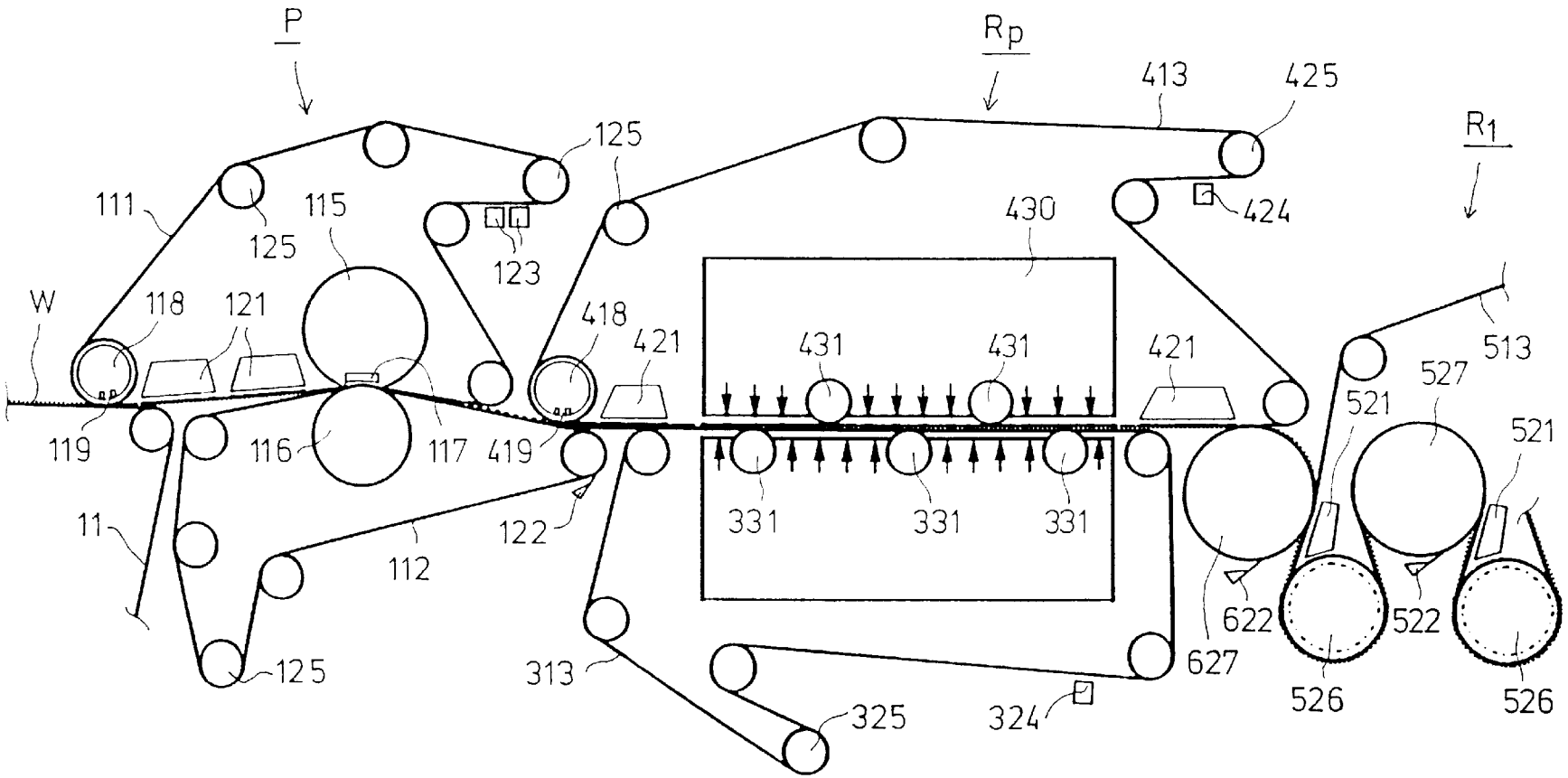
FIG. 7 is a schematic illustration of an exemplifying embodiment of the invention in which the web is passed from an impingement drying group into a group with single-wire draw by means of a drying cylinder.

The exemplifying embodiment shown in FIG. 7 is substantially similar to that shown in FIG. 6, except that after the lower-wire loop 313 of the dryer group Rp, the paper web runs on support of the upper wire 413 onto the drying cylinder 627, on which transfer between the separation of the lower wire 313 and the passing of the web to the drying cylinder 627, the support of the web W is aided by means of the blow-suction box 421. From the drying cylinder 627, the paper web W is passed to the next dryer group R1, which applies normal single-wire draw.

Figure 8:
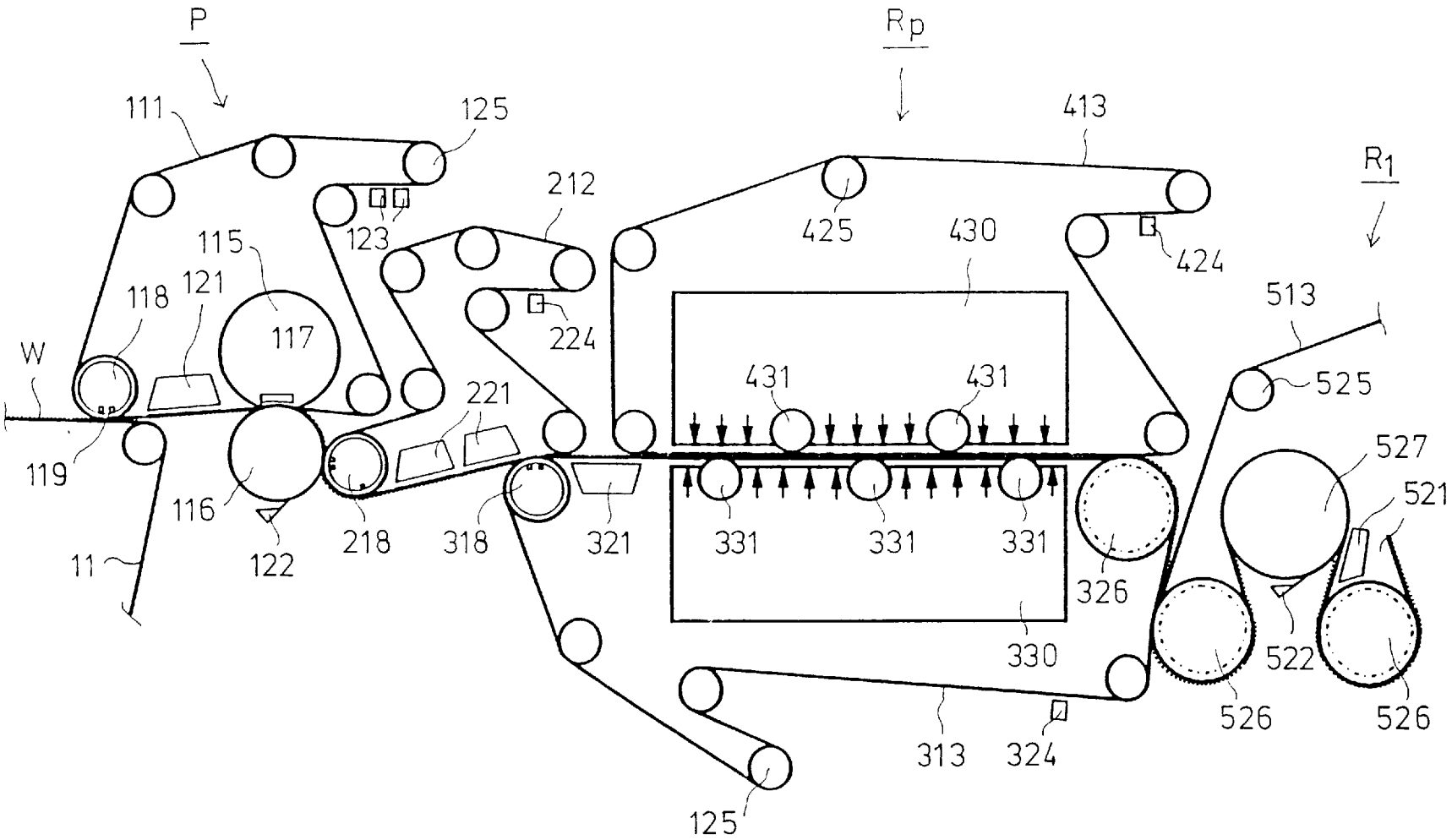
FIG. 8 shows an arrangement in which the web is passed from the smooth-faced press roll of the last press nip in the press section by means of a transfer fabric onto the lower drying wire in an impingement drying group in the dryer section.

In the exemplifying embodiment shown in FIG. 8, the paper web W enters into the last press nip P in the press section on support of the press felt 11 of the preceding press, and the web is transferred by means of the transfer suction roll 118 onto the support of the press felt 111 of the last press nip P, which support is aided by the blow-suction box 121. The extended-nip press roll 115 and the backup roll 116 form an extended-nip press, in which the roll 116 is a smooth-faced press roll. From the extended-nip, the paper web W is passed over surface of the roll 116 into a nip defined with the transfer suction roll 218 and then onto the transfer fabric 212 which is running over the transfer suction roll 218. On the support of the transfer fabric 212, which is aided by the blow-suction boxes 221, the paper web W is passed onto the lower wire 313 of the first dryer group Rp by means of the transfer suction roll 318. The paper web W runs as a substantially linear horizontal run between the impingement drying units 330,430 in the dryer group Rp on support of two drying wires 313,413, respectively. After the dryer group Rp, the paper web W is passed into the dryer group R1, which uses normal single-wire draw.

Figure 9:
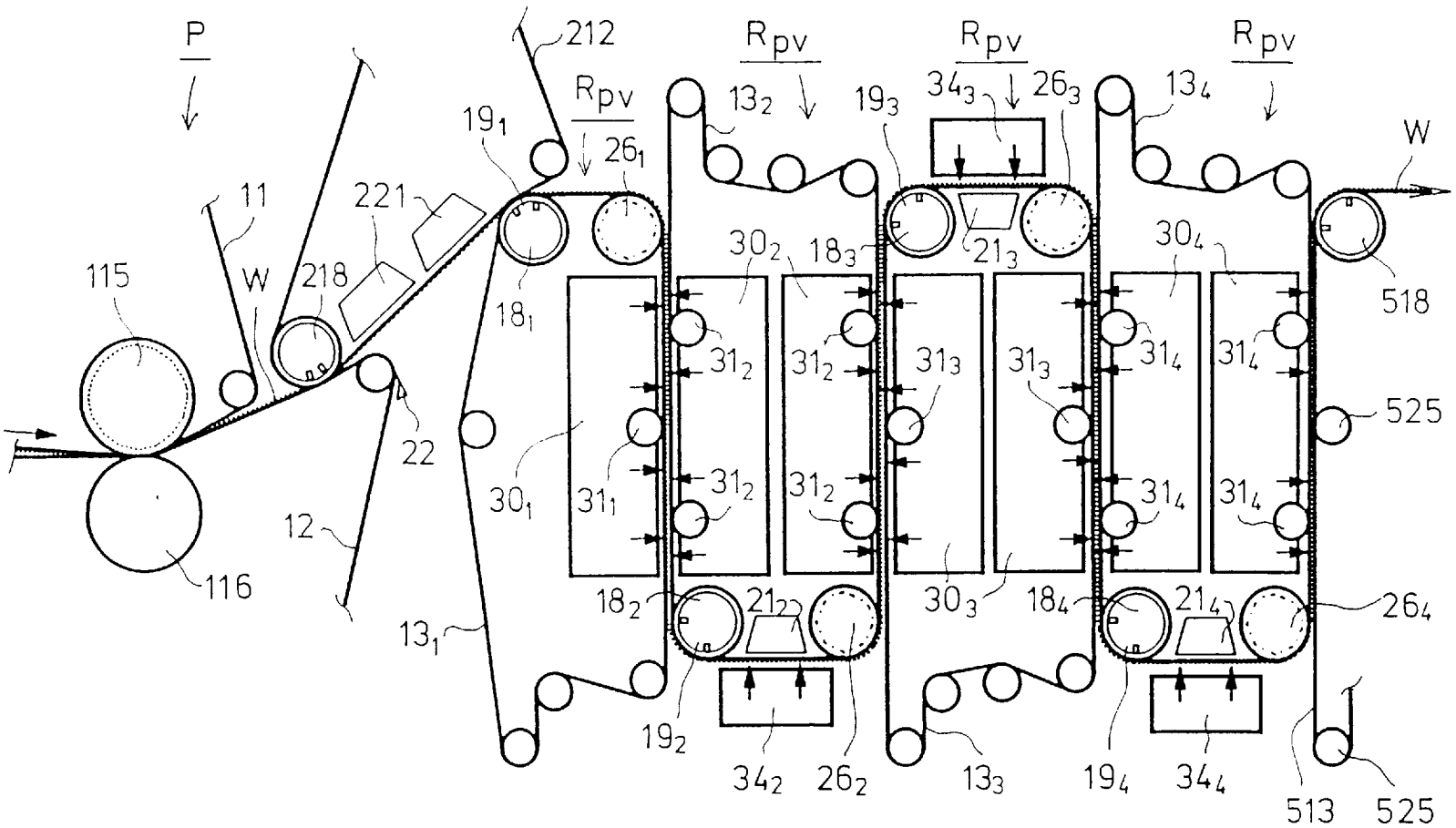
FIG. 9 is a schematic illustration of an exemplifying embodiment of the invention in which the impingement drying unit is placed vertically and the web is transferred from the lower support fabric of the press section by means of a transfer fabric onto the first fabric in the dryer section.
Figure 10:
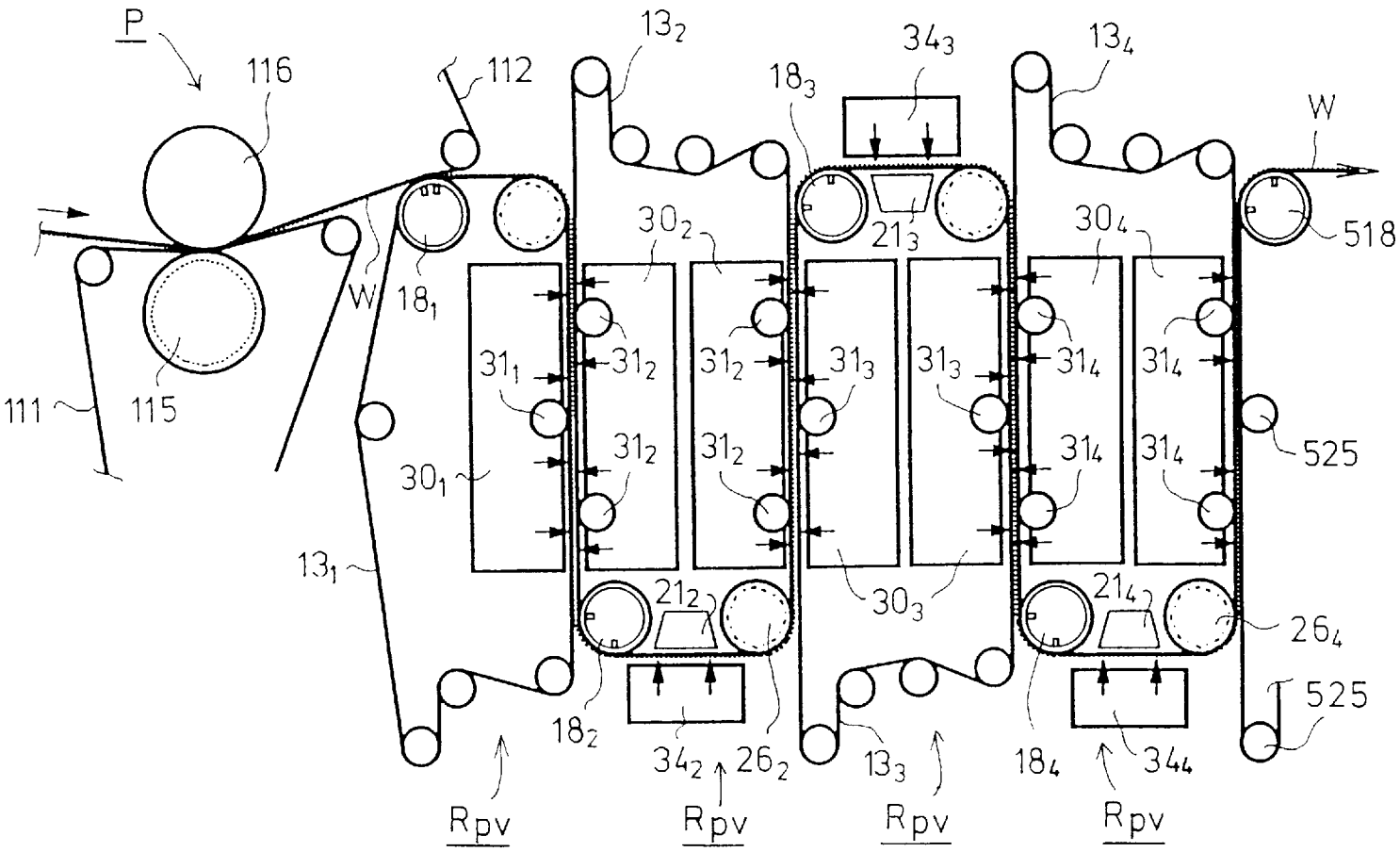
FIG. 10 is a schematic illustration of an exemplifying embodiment of the invention in which vertically positioned dryer units are employed and in which the web is passed from the press section to the dryer section by means of the upper transfer fabric in the press section.

FIGS. 9 and 10 show exemplifying embodiments of the invention in which the impingement drying units $\mathbf{30}_1, \ldots, \mathbf{30}_4$ in the dryer section are placed vertically and form vertical groups $R_{PV}$.

Inside the first drying wire $\mathbf{13}_1$ in the dryer group $R_{PV}$, there is one impingement drying unit $\mathbf{30}_1$, and inside the next drying wire $\mathbf{13}_2$, there are two impingement drying units $\mathbf{30}_2$, which blow in opposite directions so that each drying wire $\mathbf{13}_1, \ldots, \mathbf{13}_4$ operates in two groups in the support of the web W. Below the second and the fourth groups $R_{PV}$, additional impingement drying units 342,344 are placed, and at the opposite side of the web W and the drying wire 132,134, there is a blow-suction box 212,214 that promotes the drying, and a similar arrangement 343,213 is placed above the third group.

In the exemplifying embodiment shown in FIG. 9, the paper web W is passed from the last press nip in the press section, which nip is formed by the rolls 115 and 116, on support of the transfer fabric 12 onto the transfer fabric 212 by means of its transfer suction roll 218, and the web is passed onto the wire 131 circulating over the impingement drying unit $\mathbf{30}_1$ by means of the transfer suction roll $\mathbf{18}_1$.

The exemplifying embodiment shown in FIG. 10 is substantially similar to that shown in FIG. 9, but in this embodiment a separate transfer fabric is not used but rather, the upper transfer fabric 112 of the press nip P carries the paper web W directly into the press section onto the drying wire $\mathbf{13}_1$ of the first impingement drying group $R_{PV}$. In this exemplifying embodiment, the press nip formed by the press rolls 115,116 is arranged as inverted, compared with the preceding figure (FIG. 9), as the press felt 111 is placed below the paper web W.

Figure 11:
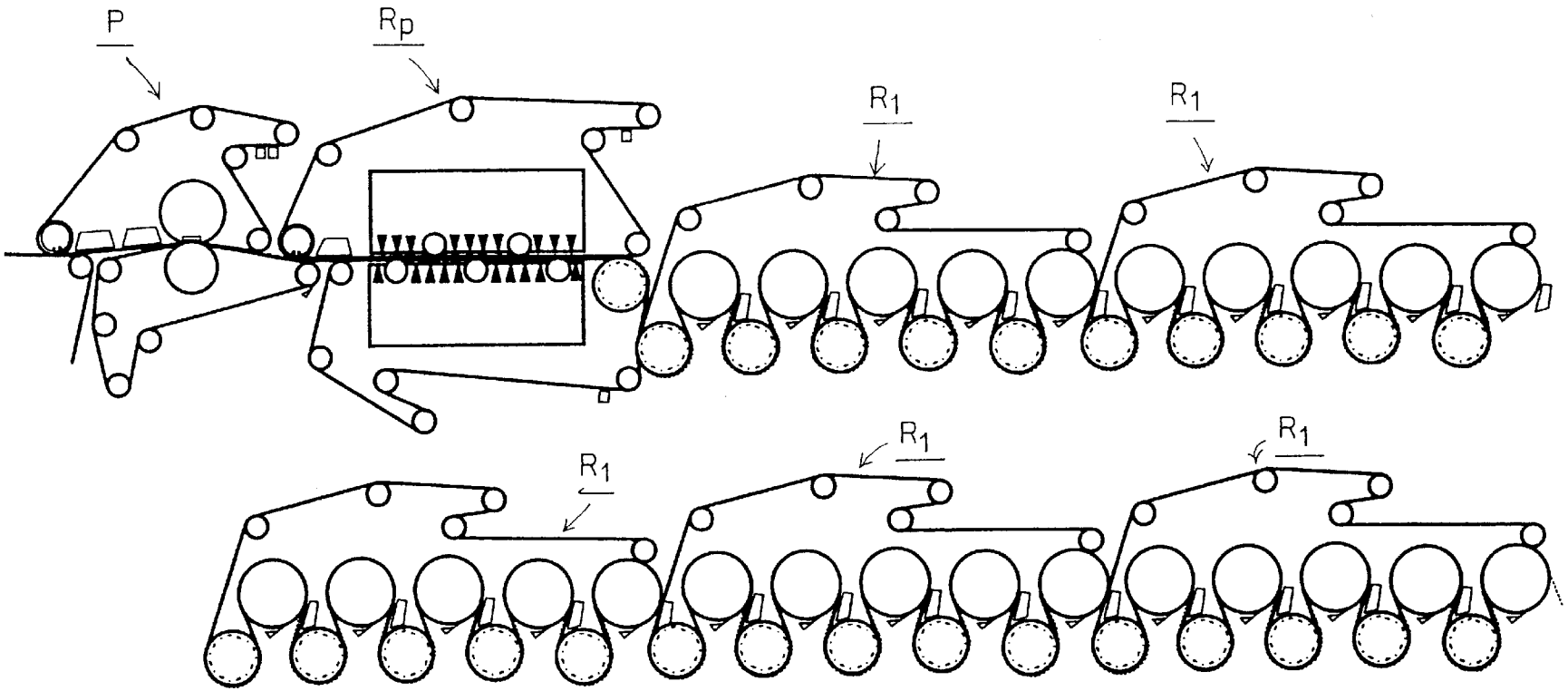
FIG. 11 is a schematic illustration of an exemplifying embodiment of the invention in which the first group after the press section is accomplished by means of impingement drying and the subsequent groups are groups with single-wire draw and with lower suction rolls.

FIG. 11 is a schematic illustration of an exemplifying embodiment of an arrangement in a paper machine which shows the last press nip P in the press section, the following first group in the dryer section, in which group impingement drying is applied, i.e., the group Rp, through which the paper web runs along a substantially linear path horizontally. This group Rp is followed by groups R1 which apply normal single-wire draw and whose number is five, as shown in the figure, or any other amount.

Figure 12:
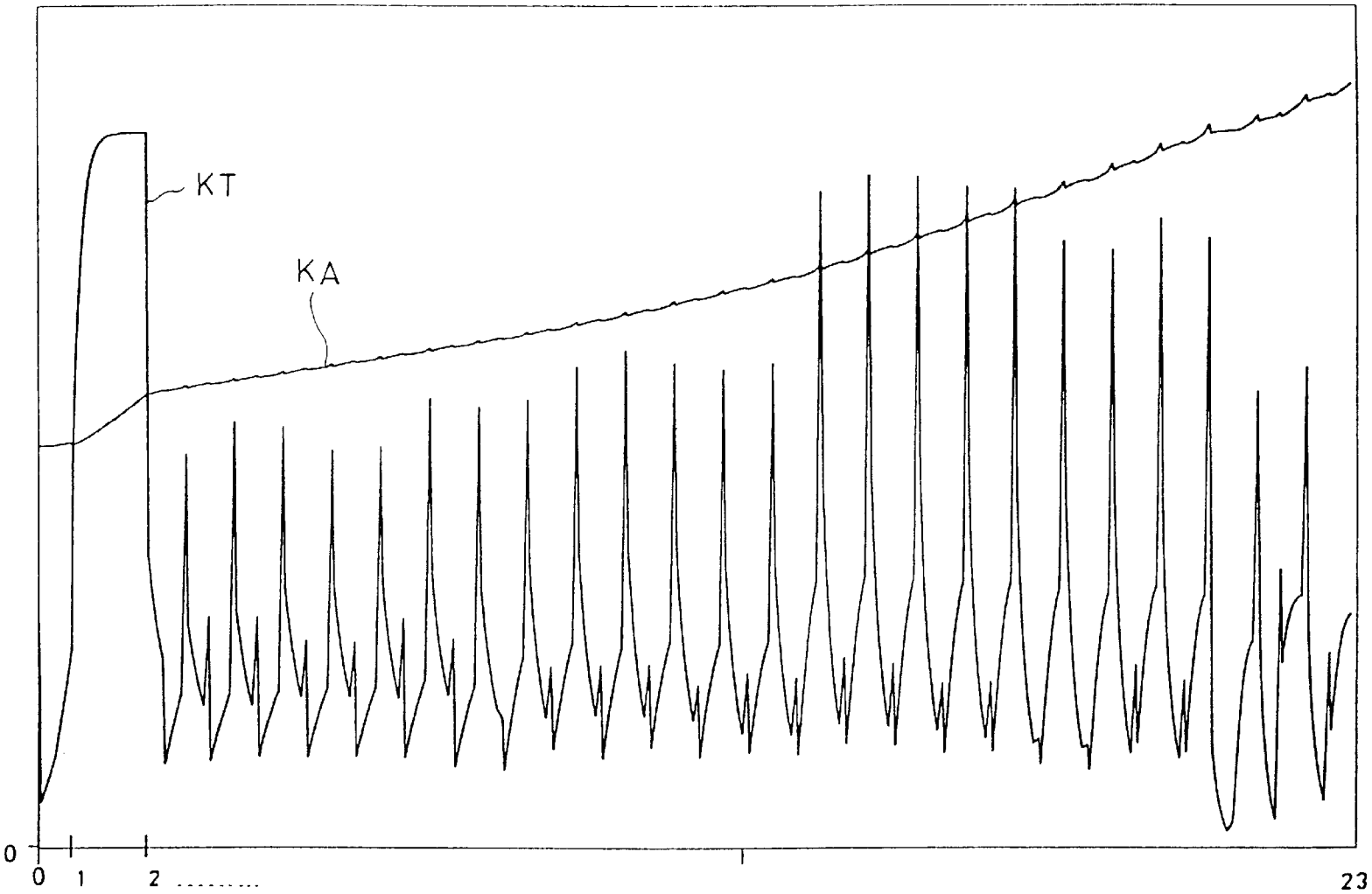
FIG. 12 illustrates the results of an exemplifying computation concerning the evaporation process in the dryer section illustrated in FIG. 11.

FIG. 12 shows computational results of such a dryer section wherein the drying efficiency KT and the dry solids content KA are established by means of a computer model when a paper web is dried in a dryer section as shown in FIG. 11.

It should be recognized that the invention is not strictly confined to the exemplifying embodiments shown in the figures and, for example, the press nips in the press can be arranged in each exemplifying embodiment either as extended-nip presses or as roll-nip presses. Further, the features in each of the illustrated embodiments can for the most part be applied in the other illustrated embodiments.

A VAC-roll is understood as the reversing suction cylinder marketed by the current assignee under the trade mark "Vac-Roll"™, an exemplifying embodiment of the construction of the rolls being described in the current assignee's U.S. Pat. No. 5,022,163, the disclosure of which is hereby incorporated by reference herein. A VAC-roll is a grooved suction roll in which there is no separate suction zone in the interior of the roll. Of course, as transfer and suction roles, it is possible to use various roll constructions in themselves known to a person skilled in the art. As reversing rolls, preferably suction rolls are used whose vacuum force applied therein is more than about 250 Pa.

The blow-suction boxes are favorably blow-suction boxes marketed by the current assignee under the trade mark "Uno Run Blow Box"™. Of course, various embodiments of impingement drying units, blow boxes and other alternative devices, which are known to a person skilled in the art, are included in the overall concept of the present invention with deviating from the scope and spirit thereof As the drying medium in the impingement drying units, air, steam, or an equivalent medium is used, and the temperature of the medium depends on the structure of the support felt or support wire or equivalent that is used, and the temperature is, for example, 70° C. to about 400° C., preferably from about 200° C. to about 400° C. The blowing from an impingement dryer is applied preferably substantially perpendicularly against the paper web to be dried and at an adequate velocity. When air is blown, the blow velocity is about 40 to about 130 m/s (meters per second), preferably from about 80 m/s to about 100 m/s, and when steam is blown, the velocity is about 60 m/s to about 200 m/s, preferably from about 100 m/s to about 170 m/s. The support fabric used in the dryer section can be very open in dryer groups provided with impingement drying units, in which case such fabrics are permeable to an abundance of air at a certain difference in pressure, for example 10,000 to about 20,000 cubic meters per square meter per hour at a difference in pressure of about 100 Pa. In impingement drying units, it is also possible to use drying wires of ordinary permeability. The impingement drying units comprise blow-nozzle openings and exhaust-air openings as well as the necessary means for blowing and removing air.

The examples provided above are not meant to be exclusive. Many other variations of the present invention would be obvious to those skilled in the art, and are contemplated to be within the scope of the appended claims.

We claim:

1. A method for enhancing the run of a web in a paper machine, comprising the steps of:

dewatering the web in a press section by pressing the web in at least one press nip, drying the web in at least one impingement drying dryer group arranged after the at least one press nip, said web drying step comprising the steps of supporting the web between a first permeable fabric and a second permeable fabric, guiding the first and second permeable fabrics while the web is supported thereon in a substantially straight run or a run having a large radius of curvature defined over a plurality of guide rolls, arranging an impingement drying device in a loop of the first permeable fabric, directing a heated medium at the web from the impingement drying device at a region in which the web is supported between the first and second permeable fabrics in said substantially straight run or said run having a large radius of curvature, arranging an additional impingement drying device in a loop of the second permeable fabric, and directing a heated medium at the web from the additional impingement drying device at a region in which the web is supported between the first and second permeable fabrics in said substantially straight run or said run having a large radius of curvature;

drying the web in at least one dryer group having single-wire draw after the web is dried in the at least one impingement drying dryer group, and constantly supporting the web on at least one support face during its passage from the at least one press nip in the press section, into and through the at least one impingement drying dryer group and into the at least one dryer group having single-wire draw such that the web is passed as a closed draw from the at least one press nip in the press section into the at least one dryer group having single-wire draw.

2. The method of claim 1, wherein the at least one press nip in the press section comprises a last press nip in the running direction of the web, further comprising the steps of:

passing the web on support of a first transfer fabric through the last press nip in the press section, transferring the web from the first transfer fabric to a second transfer fabric after the last press nip in the press section, and transferring the web from the second transfer fabric to the first permeable fabric running into a first one of the at least one impingement drying dryer group in a running direction of the web.

3. The method of claim 1, wherein the at least one press nip in the press section comprises a last press nip in the running direction of the web, further comprising the steps of:

passing the web on support of a first transfer fabric through the last press nip in the press section, transferring the web in the last press nip from the first transfer fabric to an outer face of a backup roll forming in part the last press nip, transferring the web from the backup roll to a second transfer fabric, and transferring the web from the second transfer fabric to the first permeable fabric running into a first-one of the at least one impingement drying dryer group in a running direction of the web.

4. The method of claim 1, wherein the at least one press nip in the press section comprises a last press nip in the running direction of the web, further comprising the steps of:

passing the web on support of a first transfer fabric through the last press nip in the press section, and transferring the web in the last press nip from the first transfer fabric directly onto the first permeable fabric passing into a first one of the at least one impingement drying dryer group in a running direction of the web.

5. The method of claim 1, wherein the at least one press nip in the press section comprises a last press nip in the running direction of the web, further comprising the steps of:

passing the web on support of a first transfer fabric through the last press nip in the press section, transferring the web in the last press nip from the first transfer fabric to an outer face of a backup roll forming in part the last press nip, and transferring the web from the backup roll directly to the first permeable fabric running into a first one of the at least one impingement drying dryer group in a running direction of the web.

6. The method of claim 1, wherein the at least one press nip in the press section comprises a last press nip in the running direction of the web, further comprising the steps of:

passing the web on support of a first transfer fabric through the last press nip in the press section, transferring the web in the last press nip from the first transfer fabric to the first permeable fabric, and passing the web on the first permeable fabric into a first one of the at least one impingement drying dryer group in a running direction of the web.

7. The method of claim 1, wherein the at least one press nip comprises an extended-nip press formed by an extended-nip press roll having an extended-nip press shoe arranged therein and a backup roll.

8. The method of claim 1, further comprising the step of:

transferring the web from the first permeable fabric to a dryen fabric in the at least one dryer group having single-wire draw following the at least one impingement drying dryer group in a running direction of the web as a closed draw.

9. The method of claim 1, wherein the at least one impingement drying dryer group comprises a plurality of impingement drying dryer groups further comprising the step of:

passing the web between adjacent ones of the plurality of impingement drying dryer groups as a closed draw.

10. The method of claim 1, further comprising the step of:

drying the web in the at least one impingement drying dryer group until the web has obtained a certain strength so as to endure strains caused by the single-wire draw in the at least one dryer group having a single-wire draw.

11. The method of claim 10, further comprising the step of:

constructing and operating the at least one impingement drying dryer group such that the web is dried to a dry solids content lower than 65% thereby.

12. The method of claim 10, further comprising the step of:

constructing and operating the at least one impingement drying dryer group such that the web is dried to a dry solids content lower than 60% thereby.

13. The method of claim 10, further comprising the step of:

constructing and operating the at least one impingement drying dryer group such that the web is dried to a dry solids content lower than 55% thereby.

14. The method of claim 1, further comprising the steps of:

drying the web in the at least one impingement drying dryer group until the web shrinks to a substantial extent, and constructing and operating the at least one impingement drying dryer group such that the web is dried to a dry solids content lower than 65% thereby.

15. An arrangement for enhancing a run of a web in a paper machine from a press section to a dryer section, comprising a press nip arranged in the press section, a first impingement drying dryer group arranged after said press nip in a running direction of the web, said first impingement drying dryer group comprising a first permeable fabric on which the web is supported, guide means for guiding said first permeable fabric in a loop, said guide means comprising a plurality of guide rolls, said guide means being structured and arranged to guide said first permeable fabric while the web is supported thereon in a substantially straight run or a run having a large radius of curvature defined over at least two of said guide rolls, and blow means for directing a heated medium at the web at a region in which the web is supported by said first permeable fabric in said substantially straight run or said run having a large radius of curvature, said blow means comprising a first impingement drying unit having a front face and arranged on a first side of the web and a second impingement drying unit having a front face and arranged on a second side of the web opposite said first side of the web, the heated medium being directed at the web from both said first and second impingement drying units;

a second dryer group having single-wire draw arranged after said first dryer group in the running direction of the web, and support faces for carrying the web from said press nip through said first dryer group to said second dryer group, at least one of said support faces always being in engagement with the web such that the web is passed as a closed draw from said press nip to said second dryer group, said support faces comprising said first permeable fabric which is arranged to carry the web between said first and second impingement units.

16. The arrangement of claim 15, wherein said support faces further comprise a first transfer fabric passing through said press nip for receiving the web in said press nip and carrying the web after said press nip, and a second transfer fabric arranged to receive the web from said first transfer fabric, said first permeable fabric being arranged to receive the web from said second transfer fabric and carry the web through said first dryer group.

17. The arrangement of claim 15, wherein said support faces further comprise an upper backup roll forming in part said press nip and arranged to receive the web in said press nip and carry the web after said press nip, and a first transfer fabric arranged to receive the web from said upper backup roll, said first permeable fabric being arranged to receive the web from said first transfer fabric and carry the web on a lower surface thereof through said first dryer group.

18. The arrangement of claim 15, wherein said support faces further comprise an lower backup roll forming in part said press nip and arranged to receive the web in said press nip and carry the web after said press nip, and a first transfer fabric arranged to receive the web from said lower backup roll, said first permeable fabric being arranged to receive the web from said first transfer fabric and carry the web on an upper surface thereof through said first dryer group.

19. The arrangement of claim 15, wherein said support faces further comprise a first transfer fabric passing through said press nip for receiving the web in said press nip and carrying the web after said press nip, said first permeable fabric being arranged to engage the web as it is carried on said first transfer fabric so that the web is transferred from said first transfer fabric to said first permeable fabric, said first permeable fabric being arranged to carry the web into and at least partially through said first dryer group.

20. The arrangement of claim 15, wherein said support faces further comprise an upper backup roll forming in part said press nip and arranged to receive the web in said press nip and carry the web after said press nip, said first permeable fabric being arranged to receive the web directly from said backup roll and carry the web on a surface thereof through said first dryer group.

21. The arrangement of claim 15, wherein said first permeable fabric is arranged to pass through said press nip for receiving the web in said press nip and carrying the web after said press nip into and at least partially through said first dryer group.

22. The arrangement of claim 15, wherein said press nip is an extended-nip press including an extended-nip press roll having an extended-nip press shoe arranged therein and a backup roll.

23. The arrangement of claim 15, wherein said first permeable fabric is arranged to carry the web in front of said front face of said first impingement drying unit to thereby dry the web.

24. The arrangement of claim 15, wherein said second dryer group includes a second drying wire, the web being transferred directly from said first permeable fabric to said second drying wire.

25. The arrangement of claim 15, wherein said second dryer group includes a second drying wire, said support faces further comprising a cylinder or roll arranged between said first permeable fabric and said second drying wire, the web being transferred over said drying cylinder from said first permeable fabric to said second drying wire.

26. The arrangement of claim 15, further comprising at least one additional impingement drying dryer group arranged successively after said first dryer group in the running direction of the web, said support faces being arranged to provide a closed draw of the web between adjacent ones of said first dryer group and said at least one additional impingement drying dryer group.

27. The arrangement of claim 15, wherein said support faces further comprise a second permeable fabric, the web being supported between said first and second permeable fabrics in said first dryer group.

28. The arrangement of claim 15, wherein said press nip is a roll-nip press.

29. The arrangement of claim 15, wherein said first impingement drying unit is arranged horizontally such that the web has a horizontal run proximate said front face of said first impingement drying unit.

30. The arrangement of claim 15, wherein said first impingement drying unit is arranged vertically or in a direction substantially different than a horizontal direction such that a length of said first dryer group is shorter than if said first impingement drying unit was arranged horizontally.

31. The arrangement of claim 15, wherein said first permeable fabric has a permeability to air of from about 5,000 to about 20,000 cubic meters per square meter per hour when the difference in pressure is about 100 Pa.

32. The arrangement of claim 15, wherein said first permeable fabric is arranged to carry the web over said front face of said first impingement drying unit to thereby dry the web, said first impingement drying unit being arranged to blow air at a velocity of from about 40 to about 130 meters per second.

33. The arrangement of claim 15, wherein said first permeable fabric is arranged to carry the web over said front face of said first impingement drying unit to thereby dry the web, said first impingement drying unit being arranged to blow steam at a velocity of from about 60 to about 200 meters per second.

34. The arrangement of claim 15, wherein said second dryer group includes reversing suction rolls arranged in a first row and heated drying cylinders arranged in a second row above said first row, said reversing suction roll being subjected to a vacuum higher than about 250 Pa.

35. The arrangement of claim 15, further comprising blow devices arranged in said second dryer group for stabilizing the run of the web.

36. A method for enhancing the run of a web in a paper machine, comprising the steps of:

dewatering the web in a press section by pressing the web in at least one press nip, drying the web in at least one impingement drying dryer group arranged after the at least one press nip, said web drying step comprising the steps of:

supporting the web on a first permeable fabric, guiding the first permeable fabric and a second permeable fabric while the web is supported on the first permeable fabric in a joint substantially straight run or run having a large radius of curvature defined over a plurality of guide rolls, arranging an impingement drying device in each of a loop of the first permeable fabric and a loop of the second permeable fabric, and directing a heated medium at the web from the impingement drying devices at a region in which the web is supported by the first permeable fabric in said substantially straight run or said run having a large radius of curvature;

drying the web in at least one dryer group having single-wire draw after the web is dried in the at least one impingement drying dryer group, passing the web from the at least one press nip in the press section into the at least one dryer group having single-wire draw as a closed draw, and constantly supporting the web against at least one support face during its passage from the at least one press nip in the press section, into and through the at least one impingement drying dryer group and into the at least one dryer group having single-wire draw.

37. An arrangement for enhancing a run of a web in a paper machine from a press section to a dryer section, comprising a press nip arranged in the press section, a first dryer group arranged after said press nip in a running direction of the web, said first impingement drying dryer group comprising a permeable fabric on which the web is supported, a first permeable fabric on which the web is supported, a second permeable fabric, guide means for guiding said first and second permeable fabrics each in a respective loop, said guide means comprising a plurality of guide rolls, said guide means being structured and arranged to guide said first and second permeable fabrics while the web is supported on said first permeable fabric in a joint substantially straight run or run having a large radius of curvature defined over at least two of said guide rolls, and blow means arranged in said loop of said first permeable fabric and said loop of said second permeable fabric for directing a heated medium at the web at a region in which the web is supported by said first permeable fabric in said substantially straight run or said run having a large radius of curvature;

a second dryer group having single-wire draw arranged after said first dryer group in the running direction of the web, and support faces for carrying the web from said press nip through said first dryer group to said second dryer group, at least one of said support faces always being in engagement with the web such that the web is passed as a closed draw from said press nip to said second dryer group.

* * * * *

UNITED STATES PATENT AND TRADEMARK OFFICE

CERTIFICATE OF CORRECTION

PATENT NO. : 5,865,955

DATED : February 2, 1999

INVENTOR(S) : Heikki Ilvespaa, et al.

It is certified that error appears in the above-identified patent and that said Letters Patent is hereby corrected as shown below:

On the title page, item [30] Foreign Application Priority Data change "Apr. 10, 1995' to –October 4, 1995–.

Signed and Sealed this

Twenty-ninth Day of June, 1999

*Attest:*

Q. TODD DICKINSON

*Attesting Officer*

*Acting Commissioner of Patents and Trademarks*